US005431121A

United States Patent [19]

Canepa

[11] Patent Number: 5,431,121

[45] Date of Patent: Jul. 11, 1995

[54] SAILBOAT KEEL HOIST ASSEMBLY

[76] Inventor: Jeffrey M. Canepa, 919 Ocean St., Santa Cruz, Calif. 95060

[21] Appl. No.: 294,324

[22] Filed: Aug. 23, 1994

[51] Int. Cl.[6] ..... B63B 41/00

[52] U.S. Cl. ..... 114/141; 114/39.1; 114/377

[58] Field of Search ..... 114/127, 130, 131, 138, 114/139, 140, 141, 377

[56] References Cited

U.S. PATENT DOCUMENTS

| | | | |
|---|---|---|---|
| 3,167 | 10/1868 | Stoner | 114/138 |
| 4,376,416 | 3/1983 | Carver | 114/39 |
| 4,563,971 | 1/1986 | Carver | 114/132 |

FOREIGN PATENT DOCUMENTS

| | | | |
|---|---|---|---|
| 2053804 | 11/1981 | United Kingdom | 114/138 |
| 1154142 | 5/1985 | U.S.S.R. | 114/141 |

*Primary Examiner*—Jesus D. Sotelo

*Attorney, Agent, or Firm*—Feix and Feix

[57] ABSTRACT

A keel hoist assembly for use in raising and lowering the keel of a retractable keel sailboat and including a winch unit and a generally tubular retractable support tube. The winch unit is removably mountable to a top end of the retractable support member which, in turn, fits within a tubular receiving column provided to the sailboat and extending between the bottom of the boat hull and the deck. The retractable support member is adapted for telescoping movement within the tubular receiving column and is movable between a first retracted position within the tubular receiving column and a second extended position wherein the support member is disposed extended upwardly at a distance above the top deck. locking pin members are provided to lock the support tube in the retracted and extended positions. When not in use, the winch unit is removed from the retractable support tube and stowed below deck and the retractable support member is moved to its retracted position and locked in place.

18 Claims, 4 Drawing Sheets

SAILBOAT KEEL HOIST ASSEMBLY

BACKGROUND OF THE INVENTION

1. Field of the Invention

The present invention relates generally to improvements in sailcraft which are provided with retractable keels. More particularly, the invention relates to a sailboat keel hoist assembly which is constructed to be collaspable and permit rapid disassembly for convenient out of the way stowage on the sailboat.

2. Brief Description of the Prior Art

It is becoming increasingly popular to provide high performance sailboats with a retractable keel. Such retractable keel sailboats offer many advantages over conventional sailboats which have fixed keels. For example, a sailboat having a retractable keel is easier to position and mount on a boat trailer. Also, when the keel is moved to the raised or retracted position, the mounts on the boat trailer may be adjusted such that the sailboat sits at a lower height above the ground. This yields a desirable reduction in the frontal area of the sailboat/trailer combination which, in turn, contributes to improved handling and fuel economy of the towing vehicle.

In accordance with conventional retractable keel sailboat design, the keel is retracted by pulling the keel upwardly from the hull of the boat much like a conventional dagerboard is raised from a sailboard or windsurfer. However, unlike a sailboard dagerboard, a sailboat keel is very heavy and cannot be easily raised or lowered by a single person without the aid of some mechanical advantage. For instance, the keel weight for a typical twenty foot sailboat is on the order of 450 pounds or more.

In order to facilitate the keel retraction procedure, many sailors have fashioned their own hoist assemblies for raising and lowering the sailboat keel. Typically, these home made solutions comprise a one piece hoist structure which consists of a winch that is secured to one end of a long rigid pole. The other end of the pole is adapted to fit within a receiving socket which is secured to the bottom of the hull adjacent the keel. The receiving socket is typically reinforced by a liberal amount of fiberglass and polyester resin. The pole length is selected to provide a desired lift displacement.

These single piece hoist assemblies are typically very heavy and cumbersome to use and further take up a lot of space on the sailboat. As a consequence, they are usually left at the dock or car when sailing. A problem arises in shallow water sailing conditions when it is desirable or even necessary to be able to raise the keel in order to avoid running aground and possibly causing damage to the sailboat and/or keel.

Accordingly there is a definite need in the art for an improved sailboat keel hoist which is light weight and which is constructed to permit rapid and space saving disassembly for convenient out of the way stowage on the sailboat when sailing.

SUMMARY OF THE INVENTION

A sailboat keel hoist assembly which incorporates the above desired features and which is effective to function as described above constitutes a specific object of the invention.

Briefly, a preferred embodiment of the present invention comprises a two piece keel hoist assembly for use in raising and lowering the keel of a retractable keel sailboat. The keel hoist assembly includes a winch means comprising a pulley and cable system and a generally tubular retractable support member. The winch means is removably mountable to a top end of the retractable support member. The retractable support member, in turn, fits within a tubular receiving column provided to the sailboat and which extends between the bottom of the boat hull and the deck. Preferably, the tubular receiving column also functions as a deck support member for providing support against down loading on the top surface of the deck.

The retractable support member is adapted for telescoping movement within the tubular receiving collum (or deck support member) and is movable between a first retracted position, wherein the retractable support member is disposed stowed within the tubular receiving column, and a second extended position, wherein the support member is disposed extended upwardly at a distance above the deck. Suitable hand actuable locking means such as simple locking pin members are used to lock the support tube in place within the tubular receiving column at the retracted and extended positions. The effective height distance of the winch means above the bottom of the hull when mounted atop the retractable support member (in its extended position) is sufficient to provide a desired vertical lift displacement for lifting the keel upwardly from the hull.

The keel hoist assembly is easily disassembled and collapsed for convenient out of the way stowage when not in use. For example, the winch means is removable from the retractable support tube without tools and is sufficiently compact for stowage below deck. The retractable support member can then be unlocked, moved to its retracted position, and then re-locked in place by user manipulation of the hand actuable locking pins.

In accordance with an advantageous embodiment of the invention, the tubular receiving column or deck support member is located adjacent the retractable keel at the approximate neutral center axis of the boat. Also, the retractable support tube is preferably provided with an eye member or lifting ring at its upper end. In this way, the eye member or lifting ring, being located at the neutral center axis of the sailboat, can be engaged by a crane for lifting of the sailboat into and out the water without the need for a conventional lifting sling.

In a preferred embodiment, the winch means comprises a simple hand operated winch assembly including a safety ratchet, however it is understood that powered winch assemblies may also be used with equally good results, especially for heavier keels.

In an further advantageous embodiment of the invention, the winch means includes an inclined boom member having a distal forked end or bracket sized for engaging the mast of the sailboat to facilitate mast stepping operation and to secure the mast during trailering.

Other objects and advantages of the present invention will no doubt become apparent to those skilled in the art from the following detailed description of the preferred embodiment, contained in and illustrated by the various drawing figures.

DESCRIPTION OF THE PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
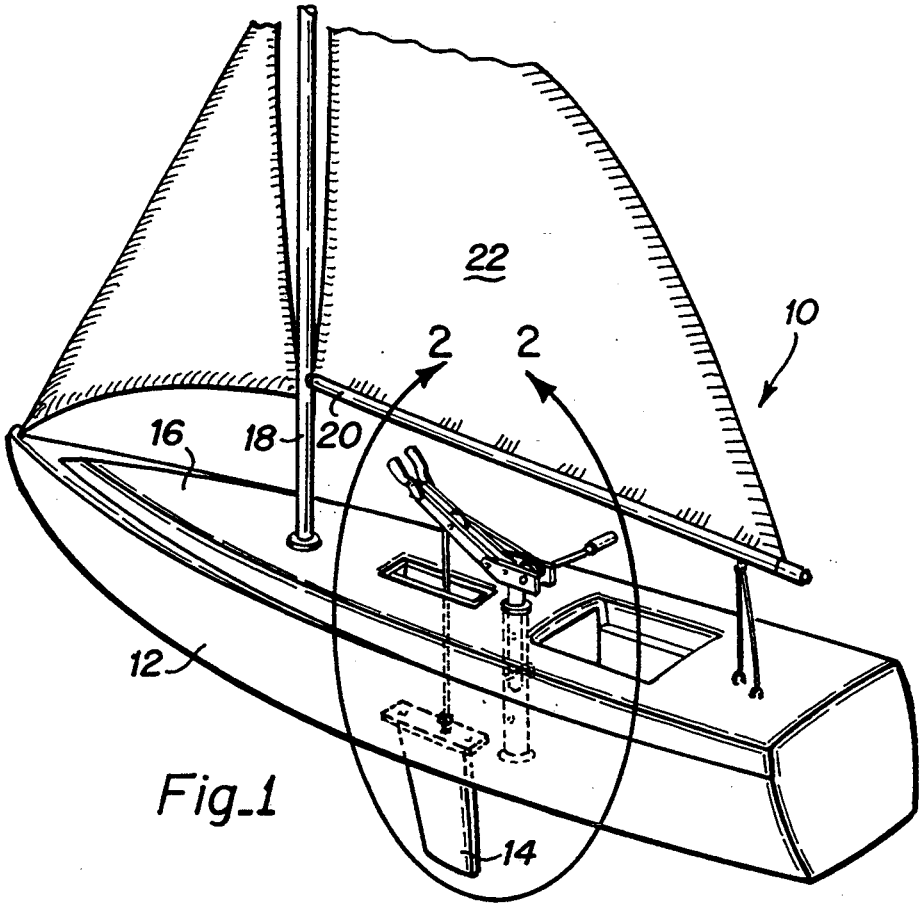
FIG. 1 is a perspective view of a retractable keel sailboat shown in combination with a keel hoist assembly constructed in accordance with one embodiment of the present invention.

FIG. 1 shows a perspective view of a typical retractable keel sailboat 10 in which the keel hoist assembly of the present invention (indicated generally within the encircled region 2—2) may be incorporated. As is conventional, the sailboat 10 generally comprises a hull 12 including a retractable keel 14, an upper deck 16, a mast 18 extending upwardly from the hull through the upper deck 16, a mast boom 20, and a main sail 22.

Figure 2:
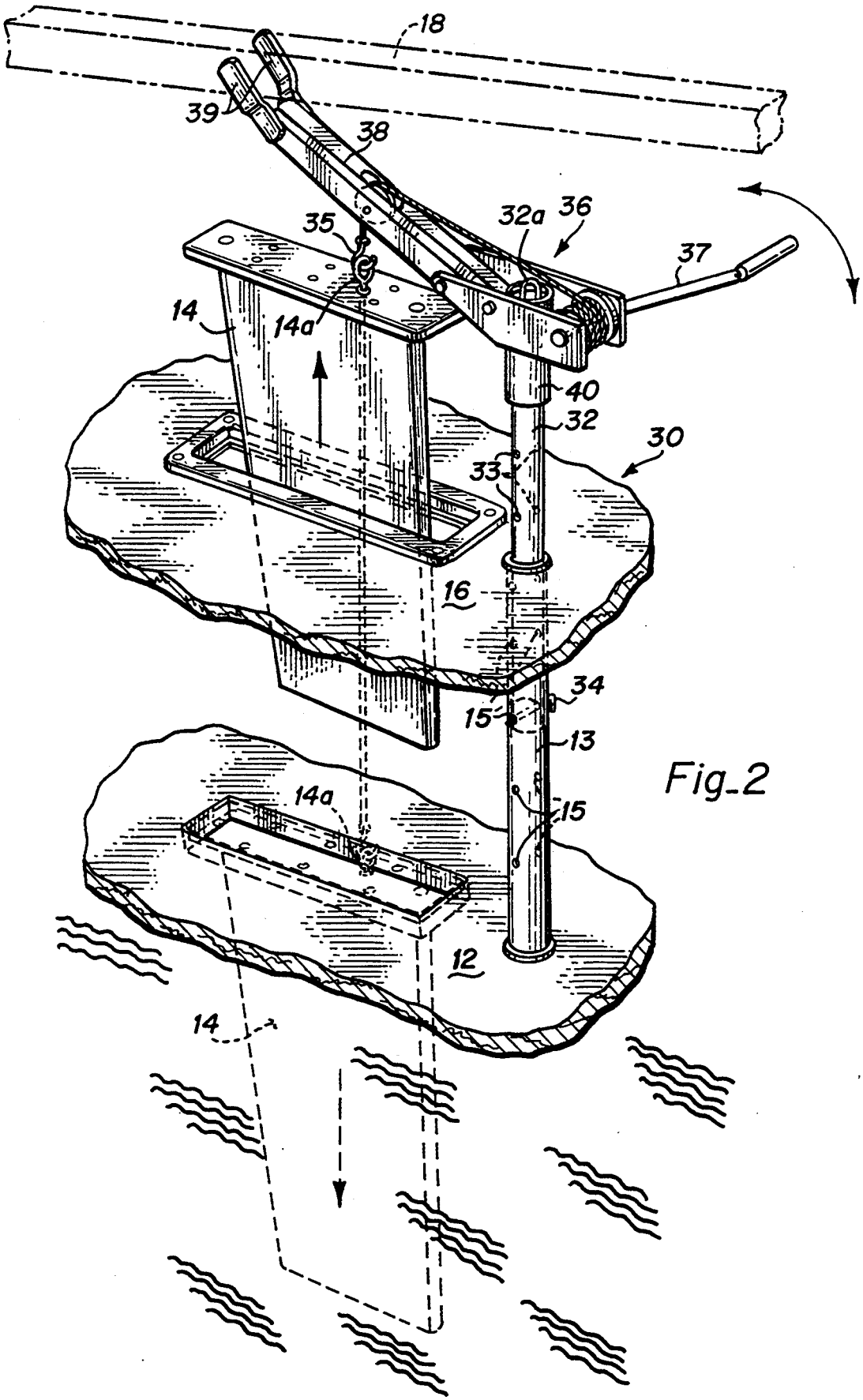
FIG. 2 is an enlarged fragmentary perspective view of the keel hoist assembly and adjacent portions of the sailboat of FIG. 1 shown encircled by arrow 2 in FIG. 1.

Referring now to FIG. 2, there is shown a close up view of the keel hoist assembly 30 constructed in accordance with one embodiment of the present invention. The keel hoist assembly 30 comprises essentially two components including a generally tubular support member 32 and a winch means 36.

The tubular support member 32 fits within a fixed receiving column 13 which is provided to the boat and which extends from the interior pan of the hull 12 to the upper deck 16. The tubular support member 32 is disposed in telescoping relationship within the receiving column 13 for movement between a first extended position as shown and a second retracted position (see for example FIG. 4). The receiving column 13 and tubular support member 32 are provided with a plurality of co-aligned through-holes 15 and 33, respectively, through which pin members 34 are removably inserted to lock the tubular support member 32 in place at the retracted and extended positions. The tubular support member 32 is also provided with an eye member or lift ring **32*a*** on its upper end.

In accordance with an advantageous feature of the invention, the provided receiving column 13 serves a dual purpose as both a conventional deck support member for buttressing against down loading on the upper deck 16 and as a bottom half portion of a telescoping vertical support which, when fully extended, provides a sufficient lift extension to permit the winch means 36 to raise the keel 14 to a desired height upward from the hull 12.

The winch means 36 preferably comprises a conventional pulley and cable type winch assembly of the kind found on most boat trailers. The winch means 36 includes a hook 37 for engaging an eye member of lift ring 14a disposed on the upper or base end of the keel 14 and a hand crank 37. The operation of the winch means 36 is also conventional, that is, as the hand crank 37 is rotated in the direction indicated by double direction arrow, the keel 14 is raised or lowered accordingly. The winch means 36 preferably includes a conventional safety ratchet mechanism so that the keel will not free fall if the handle 37 is released.

The winch means 36 includes a boom member 38 having a forked distal end 39 adapted to mate to the mast 18 for mast stepping operation (i.e. where the mast is broken down or pivoted at the mast step in preparation for trailering).

Figure 3:
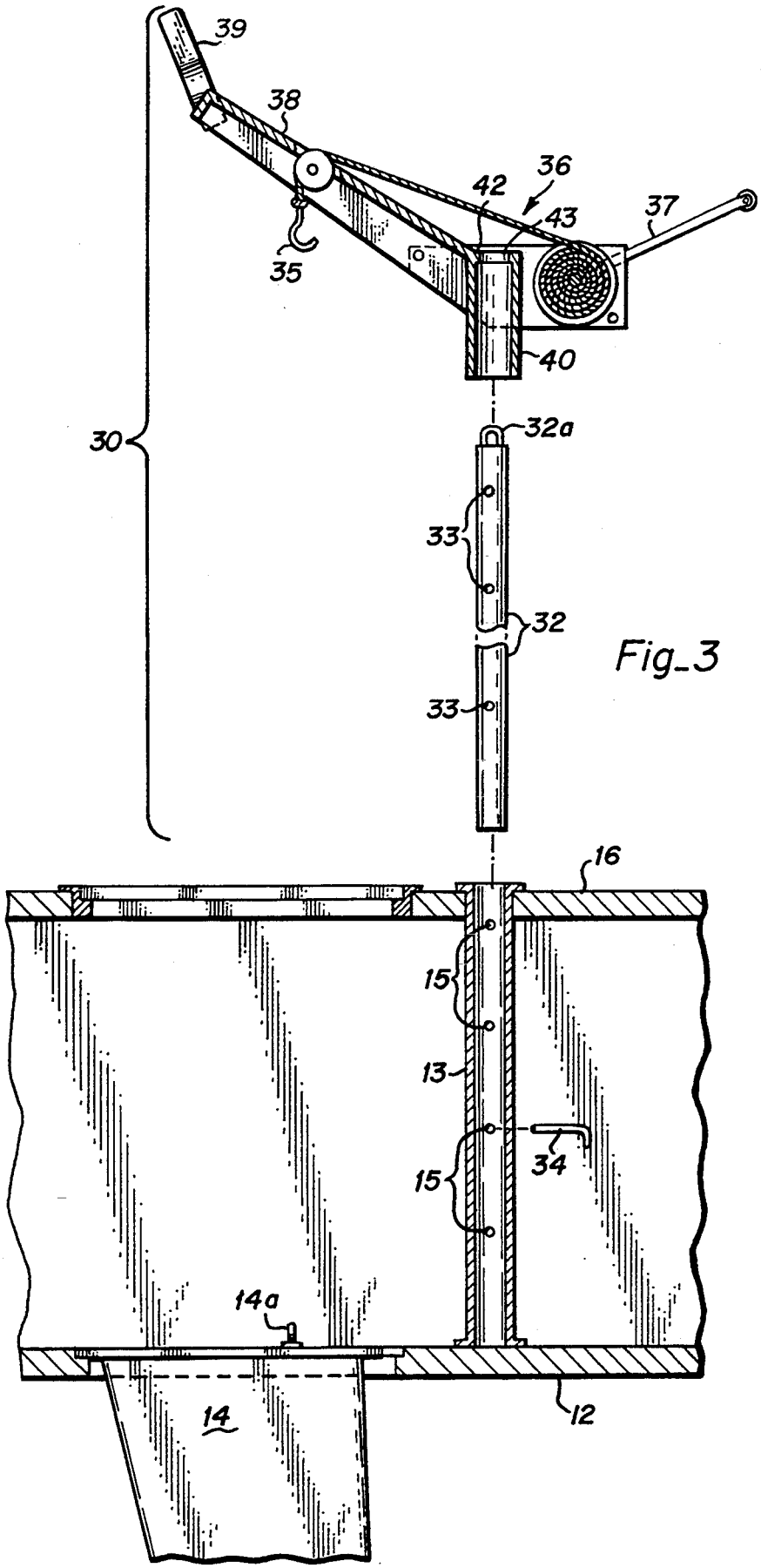
FIG. 3 is an exploded side elevation view in partial cross section of the keel hoist assembly of the present invention.

As best seen in FIG. 3, the winch means 36 further includes a slip fit mounting structure 40 fashioned as a tubular socket which is sized to fit over the upper end of the tubular support member 32. The slip fit mounting structure 40 includes a top end wall 42 which rests on top of the tubular support member 32 such that it is held in place by gravity during operation. The top end wall 42 includes a slot 42 through which protrudes the eye member or lift ring **32*a* located on the top end of the tubular support member 32. The slot 42 and eye member 32*a* are preferably co-aligned such that the boom member 38 of the winch means is co-aligned with the longitudinal center of the boat 10 to facilitate lifting and lowering of the keel 14** and also to facilitate the above noted mast stepping operation.

The keel hoist assembly 30 is easily disassembled and collapsed for convenient out of the way stowage when not in use. For example, since the winch means 36 is held in place by gravity only, it may be removed from the support member 32 without tools and is sufficiently compact in size for convenient stowage below the deck 16. The support member 32 can then be moved to its retracted position within the receiving column 13 by manipulating the locking pin 34.

Figure 4:
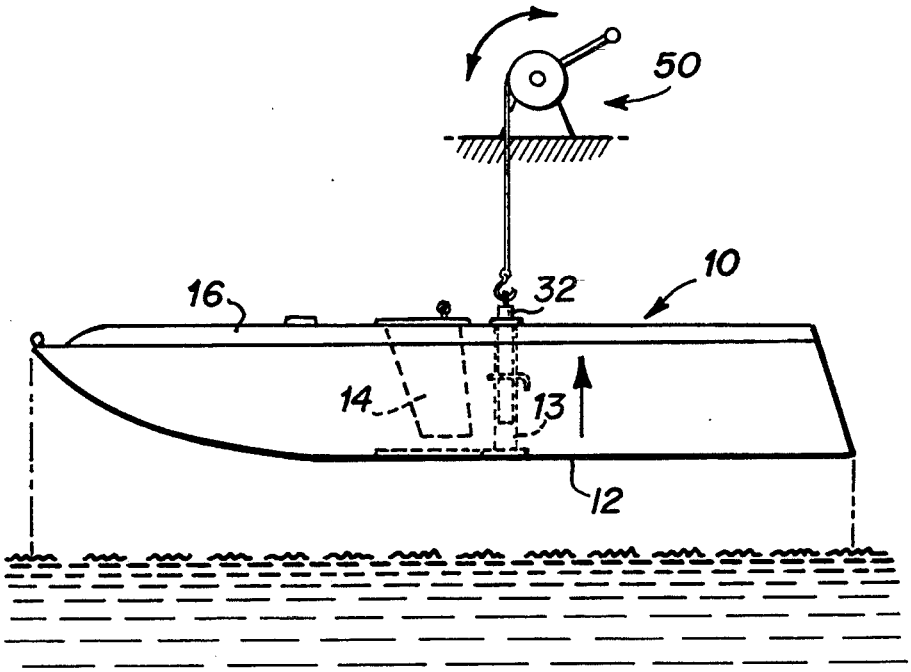
FIG. 4 is a side view which illustrates how the keel hoist assembly when in a partial disassembled state may be engaged by a crane for lifting and moving the sailboat in and out of the water.

FIG. 4 shows the tubular support member 32 of the hoist assembly 30 locked in its retracted position within the tubular receiving column 13. In accordance with an advantageous embodiment of the invention, the tubular receiving column 13 is preferably located adjacent the retractable keel at the approximate neutral center axis of the boat. As is evident from the drawing, the eye member **32*a* located at the top of the tubular support member 32 may be engaged by a crane 50 for lifting the boat 10** in and out of the water in a balanced manner without having to use a lifting sling.

Figure 5:
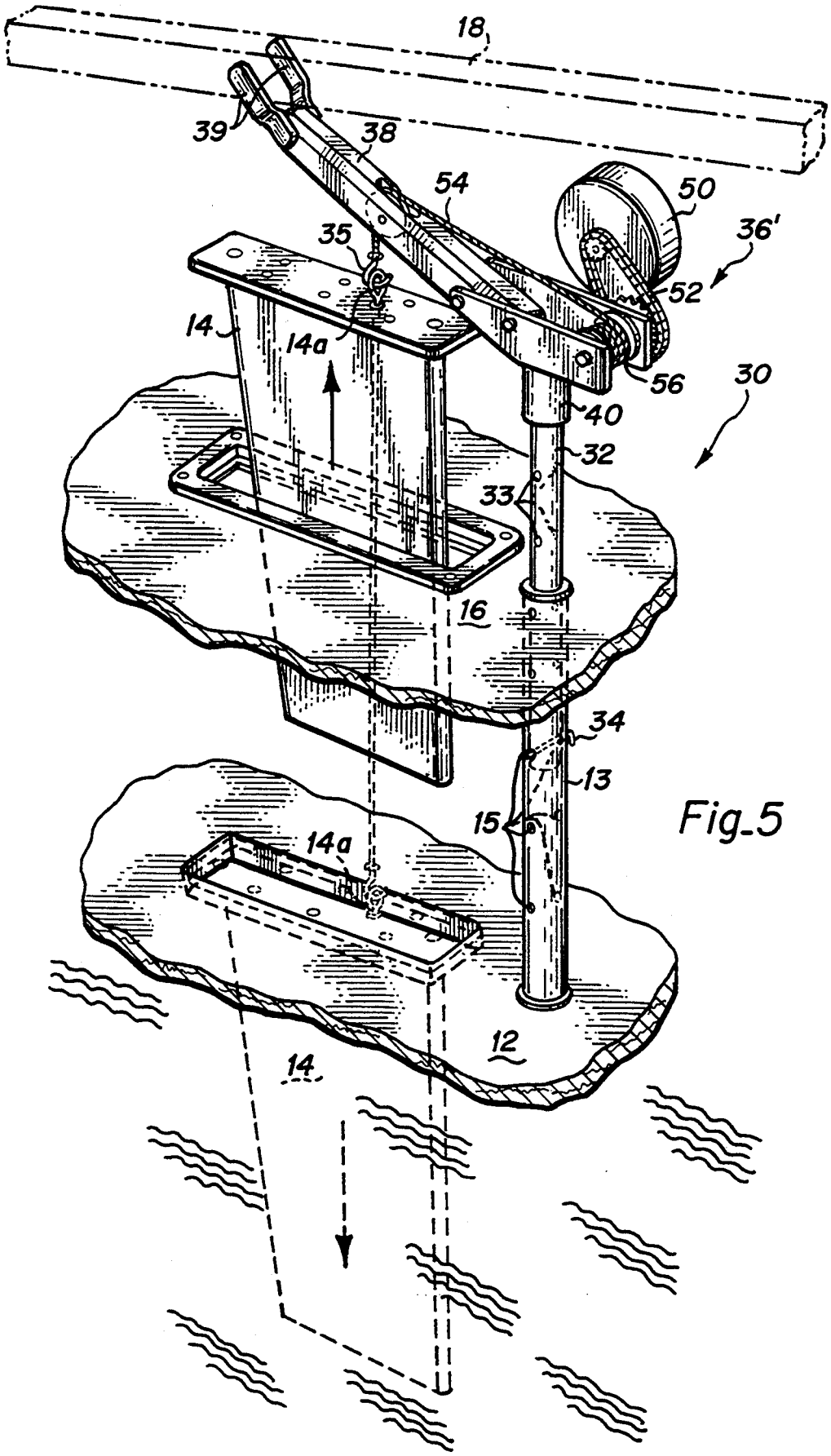
FIG. 5 is an enlarged fragmentary perspective view similar to FIG. 2 showing a powered winch as an alternate embodiment for the winch means of the present invention.

FIG. 5 is a view similar to FIG. 2 but which shows an alternate embodiment for the winch means of the present invention. In this embodiment, the manual hand crank winch unit of FIG. 2 is replaced by a powered winch unit 36' which includes a conventional motor 50 and chain drive 52 for winding and unwinding the cable about the lifting spool 56. The motor 50 preferably is light and compact and generates sufficient torque to lift heavier retractable keels on bigger boats (i.e. boats in excess of twenty feet in length). Preferred light weight and compact motors include but are not limited to conventional electric motors, diesel motors and gas motors.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

What is claimed is:

1. In a sailboat including a hull, a top deck, a mast pole extending upwardly from the hull through the top deck, sails, a main sail boom, a keel which is upwardly retractable from the hull, the improvement comprising:

a) a tubular member extending upwardly from the hull adjacent the keel, said tubular member having an upper open end connected to and forming an opening in the top deck;

b) a keel hoist assembly including:

i) a retractable support member adapted to fit within said tubular member in telescoping fashion and to be movable between a first retracted position wherein said support member is disposed stowed within said tubular member and a second extended position wherein said support member is disposed extended upwardly at a distance above said opening in the top deck;

ii) locking means for releasably locking said support member to said tubular support member in both of said first retracted position and said second extended position;

iii) winch means for hoisting the keel upwardly from the hull, said winch means being removably mountable on said support member such that when said support member is moved into said second extended position, said winch means are operative to provide a desired retraction of the keel from the hull, and when said support member is moved to said retracted position, said winch means may be dismounted from said support member for convenient out of the way stowage.

2. The invention according to claim 1 wherein said locking means comprises a pin member which is removably insertable within co-aligned throughholes contained in said retractable support member and said tubular member.

3. The invention according to claim 2 wherein:

a) the mast pole includes a mast step portion and the mast pole is pivotable between a first, upright use position and a second, generally horizontal stowed position; and b) said winch means includes an inclined boom having a forked end adapted to engage the mast step portion of the mast pole as the mast pole is pivoted into the stowed position.

4. The invention according to claim 3 wherein:

a) said tubular member is located substantially at the neutral center axis of the boat;

b) said retractable support member includes a lifting ring at an upper end thereof; and c) said lifting ring, when said retractable support tube member is locked in said first retracted position, for facilitating balanced lifting of the sailboat by engagement with a boat crane without the need for a conventional lifting sling.

5. The invention according to claim 1 wherein:

a) the mast pole includes a mast step portion and the mast pole is pivotable between a first, upright use position and a second, generally horizontal stowed position; and b) said winch means includes an inclined boom having a forked end adapted to engage the mast step portion of the mast pole as the mast pole is pivoted into the stowed position.

6. The invention according to claim 5 wherein:

a) said tubular member is located substantially at the neutral center axis of the boat;

b) said retractable support member includes a lifting ring at an upper end thereof; and c) said lifting ring, when said retractable support tube member is locked in said first retracted position, for facilitating balanced lifting of the sailboat by engagement with a boat crane without the need for a conventional lifting sling.

7. The invention according to claim 1 wherein:

a) said tubular member is located substantially at the neutral center axis of the boat;

b) said retractable support member includes a lifting ring at an upper end thereof; and c) said lifting ring, when said retractable support tube member is locked in said first retracted position, for facilitating balanced lifting of the sailboat by engagement with a boat crane without the need for a conventional lifting sling.

8. A keel hoist assembly for raising and lowering a keel in a sailboat including a hull, top deck and a retractable keel and which is provided with a deck support member in the form of a tubular member disposed adjacent the keel and extending upwardly from the hull to the top deck and forming an opening in the top deck, said keel hoist assembly comprising:

a) a retractable support member sized to fit within the tubular member in telescoping fashion and adapted to be movable between a first retracted position wherein said support member is disposed stowed within said tubular member and a second extended position wherein said support member is disposed extended upwardly at a distance above said opening in the top deck;

b) locking means for releasably locking said support member to said tubular support member in both of said first retracted position and said second extended position; and c) winch means for hoisting the keel upwardly from the hull, said winch means being removably mountable on said support member such that when said support member is moved into said second extended position, said winch means are operative to provide a desired retraction of the keel from the hull, and when said support member is moved to said retracted position, said winch means may be dismounted from said support member for convenient out of the way stowage.

9. The invention according to claim 8 wherein said locking means comprises a pin member which is removably insertable within co-aligned throughholes contained in said retractable support member and said tubular member.

10. The invention according to claim 9 wherein:

a) the mast pole includes a mast step portion and the mast pole is pivotable between a first, upright use position and a second, generally horizontal stowed position; and b) said winch means includes an inclined boom having a forked end adapted to engage the mast step portion of the mast pole as the mast pole is pivoted into the stowed position.

11. The invention according to claim 10 wherein:

a) said tubular member is located substantially at the neutral center axis of the boat;

b) said retractable support member includes a lifting ring at an upper end thereof; and c) said lifting ring, when said retractable support tube member is locked in said first retracted position, for facilitating balanced lifting of the sailboat by engagement with a boat crane without the need for a conventional lifting sling.

12. The invention according to claim 8 wherein:

a) the mast pole includes a mast step portion and the mast pole is pivotable between a first, upright use position and a second, generally horizontal stowed position; and b) said winch means includes an inclined boom having a forked end adapted to engage the mast step portion of the mast pole as the mast pole is pivoted into the stowed position.

13. The invention according to claim 12 wherein:

a) said tubular member is located substantially at the neutral center axis of the boat;

b) said retractable support member includes a lifting ring at an upper end thereof; and c) said lifting ring, when said retractable support tube member is locked in said first retracted position, for facilitating balanced lifting of the sailboat by engagement with a boat crane without the need for a conventional lifting sling.

14. The invention according to claim 8 wherein:

a) said tubular member is located substantially at the neutral center axis of the boat;

b) said retractable support member includes a lifting ring at an upper end thereof; and c) said lifting ring, when said retractable support tube member is locked in said first retracted position, for facilitating balanced lifting of the sailboat by engagement with a boat crane without the need for a conventional lifting sling.

15. A keel hoist assembly for raising and lowering a keel in a sailboat including a hull, top deck and a retractable keel and which is provided with a deck support member in the form of a tubular member disposed adjacent the keel and extending upwardly from the hull to the top deck and forming an opening in the top deck, said keel hoist assembly comprising:

a) a retractable support member sized to fit within the tubular member in telescoping fashion and adapted to be movable between a first retracted position wherein said support member is disposed stowed within said tubular member and a second extended position wherein said support member is disposed extended upwardly at a distance above said opening in the top deck;

b) at least one locking pin which is removably insertable within co-aligned throughholes contained in said retractable support member and said tubular member for releasably locking said support member to said tubular support member in both of said first retracted position and said second extended position; and c) a winch for hoisting the keel upwardly from the hull, said winch being removably mountable on said support member such that when said support member is moved into said second extended position, said winch is operative to provide a desired retraction of the keel from the hull, and when said support member is moved to said retracted position, said winch may be dismounted from said support member for convenient out of the way stowage.

16. The invention according to claim 15 wherein:

a) the mast pole includes a mast step portion and the mast pole is pivotable between a first, upright use position and a second, generally horizontal stowed position; and b) said winch means includes an inclined boom having a forked end adapted to engage the mast step portion of the mast pole as the mast pole is pivoted into the stowed position.

17. The invention according to claim 15 wherein:

a) said tubular member is located substantially at the neutral center axis of the boat;

b) said retractable support member includes a lifting ring at an upper end thereof; and c) said lifting ring, when said retractable support tube member is locked in said first retracted position, for facilitating balanced lifting of the sailboat by engagement with a boat crane without the need for a conventional lifting sling.

18. The invention according to claim 17 wherein:

a) the mast pole includes a mast step portion and the mast pole is pivotable between a first, upright use position and a second, generally horizontal stowed position; and b) said winch means includes an inclined boom having a forked end adapted to engage the mast step portion of the mast pole as the mast pole is pivoted into the stowed position.

* * * * *